United States Patent [19]

Willners et al.

[11] Patent Number: 4,698,824

[45] Date of Patent: Oct. 6, 1987

[54] METHOD FOR CONTROLLING AN ELECTROTHERMAL PROCESS

[76] Inventors: Harry Willners, Björnbo 22-218, S-18146 Lidingö, Sweden; Ove Kjölseth, Evje Terasse 4, N-1300 Sandvika, Norway

[21] Appl. No.: 794,923

[22] PCT Filed: Feb. 19, 1985

[86] PCT No.: PCT/SE85/00083

§ 371 Date: Oct. 21, 1985

§ 102(e) Date: Oct. 21, 1985

[87] PCT Pub. No.: WO85/03834

PCT Pub. Date: Aug. 29, 1985

[30] Foreign Application Priority Data

Feb. 21, 1984 [SE] Sweden ..... 84009489

[51] Int. Cl.[4] ..... H05B 7/148

[52] U.S. Cl. ..... 373/49; 373/104

[58] Field of Search ..... 373/49, 50, 102, 104, 373/105, 106, 120, 135

[56] References Cited

U.S. PATENT DOCUMENTS 4,000,361 12/1976 Bondarenko et al. ..... 373/50

FOREIGN PATENT DOCUMENTS 89046 8/1978 Japan ..... 373/49

*Primary Examiner*—Roy N. Envall, Jr.

*Attorney, Agent, or Firm*—Pollock, Vande Sande & Priddy

[57] ABSTRACT

The height position of three-phase electrodes R, S, T immersed in a resistive medium is controlled first in dependence of the values for the equivalent star network load impedances $\overline{Z}_{RO}$, $\overline{Z}_{SO}$, $\overline{Z}_{TO}$ of the electrodes, these impedances being calculated on the basis of measured values representative of valid delta network load impedances $\overline{Z}_{RS}$, $\overline{Z}_{ST}$ and $\overline{Z}_{TR}$ of the electrodes. The height positions of the electrodes are then equalized by selective adjustment of the electrical conductivity of the resistive medium at respective electrodes, preferably by using the so-called derivative method.

10 Claims, 4 Drawing Figures

METHOD FOR CONTROLLING AN ELECTROTHERMAL PROCESS

TECHNICAL FIELD

The present invention relates to the control of electrothermal processes, and more specifically to those processes in which heat is generated by passing an electric current through a plurality of electrodes into and through a resistance medium in which the electrodes are placed. The invention can be applied to particular advantage in electric reduction furnaces in which the resistance medium comprises the furnace charge or burden. It is emphasized, however, that the invention can also be applied when carrying out other electrothermal processes based on resistance heat, including arc heat. For example, appropriate parts of the invention can also be utilized in electric steel furnaces. However, since the advantages afforded by the invention are particularly large in number and most pronounced when applying the invention to processes carried out in reduction furnaces, particular reference will be made to such a furnace, and then especially to a three-phase furnace, often used in practice, in which the electric current normally passes through one or more electrodes and thereupon through the furnace charge and finally through the metal bath lying therebeneath. In principle, however, the invention can also be applied irrespective of whether the current takes this path or travels totally or partially between the electrodes.

TECHNICAL BACKGROUND

In order to effect a satisfactory process in electrometallurgical furnaces and to satisfactorily utilize their electric capacity, it is a fundamental condition that the resistance factors of the furnace and of the electrode circuits are mastered. This applies both when the process heat is generated totally or partially by direct resistance heating of the charge, as with reduction and slag smelting furnaces, and when the heat is generated totally or partially by arcs, as with steel furnaces. The composition of the charge and its conductivity interplay with internal processes (e.g. varying SiO-formations) and with purely electrical conditions, resulting in changes in the positions of the electrodes and in displacement of the electrical zero point in the furnace.

Thus, the ability of the furnace to function is predominantly dependent on the ability to measure, monitor and consciously control the resistance conditions of the electrodes. Normally, endeavours are made to achieve this control by adjusting the height of the electrode tips in the furnace charge with the aid of automatic regulators.

The electrical resistances are both electrically and metallurgically dependent. Optimum furnace performance therefore presumes contemporary electrical and metallurgical stability. It is imperative that a metallurgical balance prevails, if the electrical capacity of the furnace is to be utilized to the full. The mutual relationships of the electrical circuits and the position and stability of the electric zero point are also of special importance.

Consequently, with respect to electrode control it is particularly important to be able to use control magnitudes which correctly reflect the electrical resistance conditions.

Attempts have been made previously to control the electrodes with the aid of various control magnitudes:

- Constant current levels in the electrodes: This control method, which is rather often used, does not afford stability in the electrode positions when variations in voltage occur, but leads to so-called "dancing electrodes".
- Constant electrode power: This control method affords even less stability.
- Constant resistance: So-called resistance control has been considered the most reliable control method, but assumes that the electrical resistance between electrodes and the electrical zero point can be measured with sufficient accuracy. While this is simple in the case of single-phase furnaces, it is more complicated in the case of three-phase furnaces, because of the difficulty of access of the zero point.

In a number of processes involving a highly conductive metal bath (e.g. pig-iron), where the zero point is in all probability practically anchored within the bath, it has been possible passably to consider the furnace as three single-phase furnaces connected in parallel. In such cases it has been endeavoured to place a measuring zero at the bottom of the furnace, which is then considered to coincide relatively closely to the true zero point of the system. By measuring phase voltage and phase current of respective electrodes directly (with respect to the bottom zero point) there are obtained approximatively usable auxiliary values of the resistance of the crater zones, when the remaining furnace running conditions are carefully upheld.

This procedure is not practicable, however, in other highly important processes (high percentage Si-alloys, slag smelting etc.). The nature of the furnace as a three-phase furnace (as distinct to three parallel single furnaces) appears clearly in these cases. The zero point is by no means reliably anchored, but is able to wander readily in relation to the electrode tips, so-called "fluttering zero point". As with the aforementioned "dancing electrodes" this often results in highly instable electrode positions and resistance values. In those cases when a rotating furnace body is used, there is also the purely constructional problem of incorporating a measurement zero point in the furnace structure.

It can thus be said that the inability to discern and to render more precise, in a measurement technical fashion, those furnace parameters which, inter alia, are necessary in order to enable control of the electrodes to be effected in a satisfactory manner, has hitherto constituted a significant problem in the art with respect to the practical performance of the process.

OBJECT OF THE INVENTION

The object of the present invention is to eliminate the aforesaid problems and to provide to this end a method and an arrangement which enable current distribution in processes of the kind envisaged here to be stabilized and controlled, and which provide conditions for effecting the process in an optimum fashion, both from an electrical point of view and from a metallurgical point of view.

SUMMARY OF THE INVENTION

This object is realized by the method and the arrangement according to the invention having the features set forth in the following claims.

The method according to the invention thus comprises placing a plurality, preferably three, electrodes in a resistive medium; applying an alternating current to the electrodes so as to heat the resistive medium as the result of current passing therethrough, said electrodes forming three current-supplied net junction-points R, S, T with the load in a delta configuration; calculating load impedances of the electrodes; and adjusting the positions of the electrodes in the resistive medium in response to the calculated load impedances. The method according to the invention is mainly characterized by taking into account the relationship prevailing between delta or triangular impedances and star impedances, so-called delta-star transformation and calculating in conjunction therewith impedance auxiliary values $Z_1$, $Z_2$, $Z_3$ which are at least approximately representative of the equivalent respective star network impedances $Z_{RO}$, $Z_{SO}$ and $Z_{TO}$ of the load, i.e. $Z_1 \approx k_1 \cdot Z_{RO}$, $Z_2 \approx k_2 \cdot Z_{SO}$ and $Z_3 \approx k_3 \cdot Z_{TO}$, where the factors $k_1$, $k_2$ and $k_3$ are at least approximately equal; and by adjusting with the aid of the thus established auxiliary values the electrical zero point of the load in accordance with desired, preferably equal mutual relationships between the equivalent star-network impedances of the load, by selectively adjusting the positions of the electrodes in the resistive medium. The relationships set between the equivalent impedances shall be mutually the same particularly in the case of a symmetric electrode configuration.

According to the invention the impedance auxiliary values are calculated advantageously by calculating first impedance values $Z'_{RS}$, $Z'_{ST}$ and $Z'_{TR}$ which are at least approximately representative of the load delta network impedances $Z_{RS}$, $Z_{ST}$ and $Z_{tr}$ respectively, and then obtaining said impedance auxiliary values by multiplying said first impedance values in pairs, i.e. $Z_1 = Z'_{RS} \cdot Z'_{TR}$; $Z_2 = = Z'_{ST} \cdot Z'_{RS}$ and $Z_3 = Z'_{TR} \cdot Z'_{ST}$. These equations from which the impedance auxiliary values are derived correspond to the numerator in the known relationship applicable to deltastar transformation, as will be made evident hereinafter. Since the denominator can be considered as a constant, it need not normally be taken into account.

It is emphasized that although impedances are complex magnitudes we are able here to utilize the value of respective magnitudes.

Thus, instead of basing the measurements on a more or less unreliable measurement zero (as a reference point), the total load on the furnace is treated in accordance with the invention as an equivalent star-connected or Y-connected impedance group which per se corresponds to the nature of the furnace. The true electric zero point of the furnace is therewith the reference point, and the resistances in the impedances of the star group may be considered natural characteristics of the process metallurgical conditions at each electrode. Respective reactances will normally be substantially the same, at least in the case of a symmetrical configuration.

It is emphasized that the aforesaid first impedance values and "delta network impedances" (i.e. the impedance auxiliary values) can be measured and calculated with the aid of fixed measuring points, which are often already present in older installations and which can be established very readily in new installations and in a simple way as the rest) totally independently of any "synthetic" measurement zero and without any trouble, even in the case of a rotating furnace body. "Star network impedances" (i.e. said impedance auxiliary values) can be calculated on-line, for example with the aid of conventional data equipment, and the calculation results can be presented directly in ditigal form, or with the aid of indicating instruments or data display screen, and used for automatic electrode control.

When the network junction points R, S, T are connected to transformer secondary windings in a delta coupling, it has been found possible to base the aforesaid first impedance values quite simply on a delta network current value $I_{RS}$, $I_{ST}$ and $I_{TR}$ respectively. In order to achieve the best results, these delta network current values can be measured on the secondary side of the transformer. The primary side of the transformer is also normally delta connected and hence respective delta network current values can also be measured on this side of the transformer with sufficient accuracy.

In a further simplified method according to the invention delta network approximative current values $I_{RS}'$, $I_{ST}'$ and $I_{TR}'$ respectively for use as said delta network current values can be produced by a star-network connected measurement of incoming supply currents $I_{R,in}$, $I_{S,in}$; and $I_{T,in}$ to delta-connected transformer configuration and subsequent delta network connected differential-current determination.

As will be understood, if a greater degree of accuracy is desired respective associated voltage values, preferably the delta network voltage values $U_{RS}$, $U_{ST}$ and $U_{TS}$ respectively associated with the network junction points, R, S, T can be used for determining the aforesaid first impedance values in addition to the delta network current values. In this way better attention is paid to imbalances in transformer conversions, transformer impedances, etc. It will be noted that the measurement of current and voltage need not necessarily take place at the same location.

It will also be understood that it is possible to effect total delta-star transformation, the aforesaid auxiliary values being obtained by dividing each of the values obtained in the aforesaid pairwise multiplications with a factor corresponding to the denominator in the delta star transformation formula.

It is emphasized that even though control in accordance with the invention is effected with the aid of the auxiliary or approximative values, which may be encumbered initially with appreciable errors, the accuracy will increase progressively as the electrical zero point stabilizes. Thus, the control advantageously has the character of a repeated process which ultimately provides a fully balanced and stabilized condition, where the auxiliary or approximative values reflect the desired values extremely well.

By utilizing "calculated star network impedances" (i.e. said impedance auxiliary values) for electrode control, there is obtained a preliminary stabilization of the electrical zero point. In the case of symmetrical electrode configuration (symmetrical furnace) the positions of the electrodes (normally their height positions) are thus adjusted so that "calculated star network impedances" become mutually identical and suitably also numerically adapted to empirical values suitable for furnace operation. In the case of asymmetric electrode configuration or furnace, the electrodes are adjusted so that "calculated star-network impedances" have constant predetermined mutually relationships.

In conjunction with the aforesaid preliminary stabilization of the electric zero point, the furnace has been brought to a preliminary electrical balance, i.e. both the electrical zero point and the individual electrode positions have been preliminarily stabilized in conformity with the conductivity conditions prevailing at that moment in time in respective electrode zones. The electrode tips, however, will be located at different height levels in the furnace charge or burden as mutual differences occur between the conductivity of the electrode zones.

In order to obtain a final stabilization with full electric balance and metallurgical balance sought for, it is now possible in accordance with the invention to equalize the positions of the electrodes in the charge or burden, i.e. to ensure that the electrode tips have mutually the same height positions. This is effected by selectively adjusting (while maintaining the preliminary stabilization) the input composition of the resistive medium, and therewith its conductivity at respective electrodes, and/or by applying a special material directly to the upper surface of the charge or burden in the vicinity of respective electrodes. In this regard an increase in conductivity will elevate the position of the electrode and vice versa, with remaining conditions unchanged.

Subsequent to this final stabilization, the electrodes are able to function as a well coordinated and mutually balanced unit. This unit can now be brought to a working position, which suitably can be determined empirically for a given furnace and a given starting material.

In the case of a fully symmetrical configuration, the aforesaid final stabilization can be expected to correspond to identical and stable resistances (R) of the star network impedances (Z).

It is emphasized that as the height positions of the electrode tips are gradually equalized, the risk of undesirable current paths appearing between the electrodes and causing changes in the metallurgical performance, e.g. increased SiO-formation in connection with Si-reductions, decreases.

When adjusting the conductivity for the purpose of achieving the aforesaid final stabilization, it is possible to derive instructive guidance in various ways. In accordance with one preferred method of the invention there is used in this respect a so-called derivative method (c.f. for example SE-B-No. 315 057 or U.S. Pat. No. 3,375,318 to which reference is made here and the contents of which shall herewith be considered to be taken up in the present text) to determine a comparison value for respective electrodes corresponding to the relationship between the star network impedance (Z) of the electrode and the derivative (dZ/dh) of the star network impedance (Z) with respect to the position (h) of the electrode tip. The thus determined comparison values are utilized as those values on which said adjustment is based. Such comparison values will provide good, more direct indication of the height positions of the electrode tips and therewith the necessary material additives for achieving the aforesaid final stabilization. It will be understood that in practice the aforementioned impedance auxiliary value is used as the star network impedance value. The determined comparison value will be representative, due to having achieved the preliminary stabilization.

As is more clearly disclosed in the aforesaid SE B No. 315 057, the derivative method involves measuring said derivative upon a slight cyclic change in the height position of respective electrodes. In processes in which molten material is tapped-off intermittently, where the height of an electrically conductive layer is changed between tapping occasions, measurements of the aforesaid derivative are suitably carried out at a point in time at which the greatest difference in the impedance value is obtained for a small change in the height position of the electrode tips.

Stabilization in accordance with the invention also enables, often in a simple fashion, a star network resistance value for a respective electrode (star network junction) to be measured relative to a suitably selected, accessible constructed zero point (measurement zero), which while observing the electrode configuration and the setting of the electrical zero point of the load through the preliminary stabilization can be expected to correspond to the latter. Adjustments can then be carried out, beginning from such measured star network resistance values.

The constructed zero point may suitably be located in the conductive bottom of the furnace, above which bottom there is located a layer of molten material, which often exhibits good electric conductivity. When the furnace bottom and furnace walls include electrically conductive material, it is possible in many instances to place the constructed zero point almost anywhere on the furnace bottom or the furnace walls. This enables reliable, measured star network resistance values of the aforesaid kind to be obtained in an extremely simple fashion while using simple conventional measuring equipment.

The invention will now be described in more detail with reference to the accompanying drawings.

DESCRIPTION OF EMBODIMENTS

Figure 1:
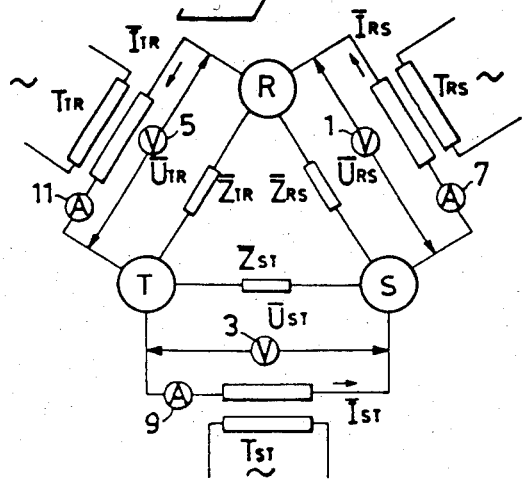
FIG. 1 is a schematic circuit diagram of a symmetric three-phase furnace operating with three electrodes, the electrode load being indicated by its corresponding delta network impedances.

The arrangement illustrated in FIG. 1 relates to symmetric three-phase furnace, which may be a reduction furnace, an alloying furnace, a slag smelting furnace or a steel furnace, for instance, and in which three electrodes R, S and T are vertically submerged into the burden (not shown) charged to the furnace container. The electrodes are symmetrically arranged, so as to be located in respective corners of an equilateral triangle. The electrodes are supplied with current through three single-phase transformers, the primary sides of which are connected to a conventional three-phase network. The secondary side of the transformer $T_{RS}$ is connected to the electrodes R and S and supplies the current $\bar{I}_{RS}$. The secondary side of the transformer $T_{ST}$ is connected to the electrodes S and T and supplies the current $\bar{I}_{ST}$. The secondary side of the transformer $T_{TR}$ is connected to the electrodes T and R and supplies the current $\bar{I}_{TR}$. The voltages $\bar{U}_{RS}$, $\bar{U}_{ST}$ and $\bar{U}_{TR}$ across respective secondary sides are measured with the aid of corresponding conventional voltmeters 1,3,5, which are only shown schematically and which are connected to fixed voltage output terminals on the electrodes R, S and T. The currents $\bar{I}_{RS}$, $\bar{I}_{ST}$ and $\bar{I}_{TR}$ are measured with the aid of conventional ammeters 7, 9 and 11, which are shown only schematically, whereby the electrode currents are also available for measurement.

In FIG. 1 the load on the electrodes R, S, T are indicated by corresponding delta network impedances $\bar{Z}_{RS}$, $\bar{Z}_{ST}$ and $\bar{Z}_{TR}$. These are calculated from the voltage and current measurement values obtained by the voltmeters and ammeters 1, 3, 5 and 7, 9, 11 respectively:

$$\bar{Z}_{RS} = \frac{\bar{U}_{RS}}{\bar{I}_{RS}}; \bar{Z}_{ST} = \frac{\bar{U}_{ST}}{\bar{I}_{ST}}; \bar{Z}_{TR} = \frac{\bar{U}_{TR}}{\bar{I}_{TR}}$$

Figure 2:
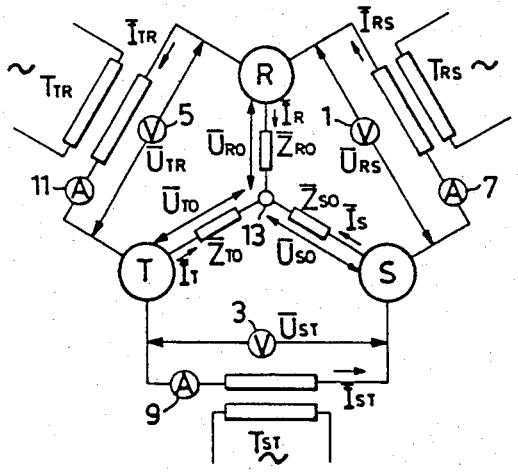
FIG. 2 is a diagram similar to that of FIG. 1, but with the electrode load indicated by its assumed equivalent star network impedances in accordance with the invention.

In the FIG. 2 embodiment these delta network impedances have been replaced by the equivalent star network or Y-impedances $\bar{Z}_{RO}$, $\bar{Z}_{SO}$ and $\bar{Z}_{TO}$, the electrical zero-point being referenced 13. These equivalent impedances can be calculated in accordance with the following relationships:

$$\bar{Z}_{RO} = R_{RO} + j \cdot X_{RO} = \frac{\bar{Z}_{RS} \cdot \bar{Z}_{TR}}{\bar{Z}_{RS} + \bar{Z}_{ST} + \bar{Z}_{TR}}$$

$$\bar{Z}_{SO} = R_{so} + j \cdot X_{SO} = \frac{\bar{Z}_{ST} \cdot \bar{Z}_{RS}}{Z_{RS} + Z_{ST} + Z_{TR}}$$

These equivalent impedances, which will be unequal, are used in the preliminary stabilizing process as control magnitudes for electrode control, so as to change the height positions of the electrodes to render the impedances equal and thereafter to maintain the impedances mutually equal.

The impedances in the above relationship are complex magnitudes, which complicate the calculations. According to the invention, however, it is possible to work with the impedance values with good approximation. In addition, when taking into consideration the fact that the denominators in the above expression can be assumed to be at least approximately equal there is then obtained:

$Z_{RO} \approx$ proportionality factor$\cdot Z_{RS} \cdot Z_{TR}$ $Z_{SO} \approx$ proportionality factor$\cdot Z_{ST} \cdot Z_{RS}$ $Z_{TO} \approx$ proportionality factor$\cdot Z_{TR} \cdot Z_{ST}$.

Thus, the three products $Z_{RS} \cdot Z_{TR}$, $Z_{ST} \cdot Z_{RS}$ and $Z_{TR} \cdot Z_{ST}$ can be used for electrode control. The electrodes are adjusted so that the three products become mutually the same. Preferred methods of producing representative values for $Z_{RS}$, $Z_{ST}$ and $Z_{TR}$ will be disclosed hereinafter with reference to FIG. 3.

Figure 3:
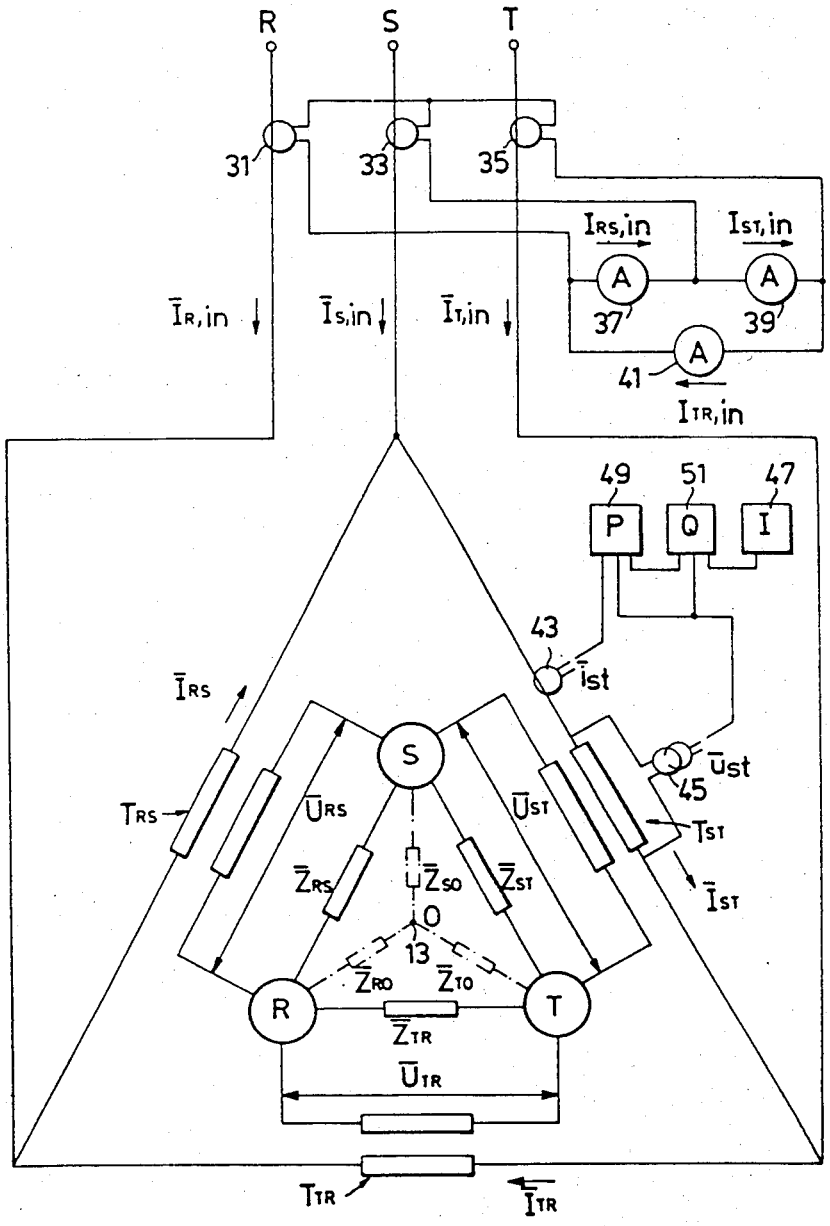
FIG. 3 is a schematic circuit diagram of substantially the same kind as that illustrated in FIGS. 1 and 2, showing the connection of the transformers used to the mains and two alternative measurement connections.

FIG. 3 illustrates the three transformers $T_{RS}$, $T_{ST}$ and $T_{TR}$ connected to a three-phase network. The primary sides of the transformers are delta-connected to three phases R, S and T of the network. The figure illustrates two alternative methods of producing the representative values of the impedances $Z_{RS}$, $Z_{TR}$ and $Z_{ST}$.

According to the first, and particularly simple method there are used three conventional current transformers 31, 33 and 35 for measuring respective incoming "phase currents" $I_{R,in}$, $I_{S,in}$ and $I_{T,in}$. The current transformers are star network connected, but are also connected to three ammeters 41 connected in a triangular configuration. The outputs of the current transformers are connected to respective corners of the ammeter triangle. The ammeters are adapted to measure $I_{RS,in}$, $I_{ST,in}$ and $I_{TR,in}$. These measurement values form the delta network approximate current values for the delta network current values on the secondary side of the transformers, i.e. approximate values of the impedances $Z_{RS}$, $Z_{st}$ and $Z_{TR}$. It will be understood that the approximative values become progressively more accurate as stabilization of the electrical zero point continues, i.e. as the impedances $Z_{RS}$, $Z_{ST}$ and $Z_{TR}$ become more equal.

According to the other method both current and voltage on the primary side of respective transformers are measured with the aid of a conventional current transformer 43 and a conventional voltage transformer 45. These are connected in a conventional manner to an ammeter or current meber 47, an active power meter 49 and a reactive power meter 51, all of which are of conventional design. With the aid of the relationship active power $P = I^2 \cdot R$ and reactive power $Q = I^2 \cdot X$ there is obtained a first impedance value which is representative of the corresponding delta network impedance of the load, in the form of $$Z = \frac{1}{I^2} \cdot \sqrt{P^2 + Q^2}$$

Thus, such as impedance value is calculated for each of the transformers $T_{RS}$, $T_{ST}$ and $T_{TR}$ with the aid of a respective set of means 43, 45, 47. The three calculated impedance values are used as the previously mentioned values $Z_{RS}$, $Z_{ST}$ and $Z_{TR}$. Losses etc. in the transformers can normally be ignored, particularly since adjustment of the electrical zero point of the load in accordance with the invention causes the transformers to be loaded to mutually the same extent. All of these transformers can consequently be utilized to a maximum.

The currents through the equivalent impedances, i.e. the currents ("phase currents") $\bar{I}_R$, $\bar{I}_S$ and $\bar{I}_T$ delivered by the electrodes R, S, T are available as follows:

$$\bar{I}_R = \bar{I}_{RS} - \bar{I}_{TR}; \bar{I}_S = \bar{I}_{ST} - \bar{I}_{RS}; \bar{I}_T = \bar{I}_{TR} - \bar{I}_{ST}$$

The voltages $\bar{U}_{RO}$, $\bar{U}_{SO}$ and $\bar{U}_{TO}$ across the equivalent impedances, i.e. between respective electrodes R, S, T and the electrical zero point 13 ("the phase voltages") on the other hand are not directly available for measurement. Consequently, the resistances $R_{RO}$, $R_{SO}$ and $R_{TO}$ are not directly available for use as control magnitudes.

As beforementioned, however, it is possible in many instances—due to the preliminary stabilization—to replace the electrical zero point 13 with a constructed measurement zero, for example, in the furnace bottom. In this way, the "phase voltages" $U_{RO}$, $U_{SO}$ and $U_{TO}$ can be readily measured, normally with a high degree of accuracy, between the measurement zero point and fixed voltage measurement outputs for the electrodes R, S, T, whereafter resistances corresponding to $R_{RO}$, $R_{SO}$ and $R_{TO}$ can be calculated while taking into account the phase angle between "phase voltage" and "phase current" ($R_R = Z_R \cdot \cos \phi$). The thus calculated resistance values may be disclosed on suitable instruments, as a guidance for resistance setting and other process control functions.

Subsequent to effecting the aforesaid preliminary stabilization, the electrode tips may have mutually different height levels, even though "the phase resistances" have been brought to mutually different values. This is due to metallurgically conditional dissimilarities between the conductivity of the crater zones. The dissimilarities are normally caused by varying "carbon strength" within the burden. In order to accomplish a perfect furnace run it is necessary to equalize the conductivities and therewith the electrode positions.

In accordance with the invention it is advantageous to use the aforesaid so-called derivative method for determining for respective electrodes a derivative value (dZ/dh), i.e. the derivative of the impedance Z with respect to the height position h of the electrode, and to construct a functional value Z·(dh/dZ) and to utilize this value for final stabilization. In this respect an adjustment is made so that the functional values Z·(dh/dZ) are equal in respect of all the electrodes, therewith achieving the aforesaid equalization. The impedance value used is suitably the same as that used in conjunction with the preliminary stabilization, i.e. an impedance auxiliary value representative of the star network impedance of the load. It is also possible, however, to use a calculated star network resistance value in conjunction with the derivative method.

Figure 4:
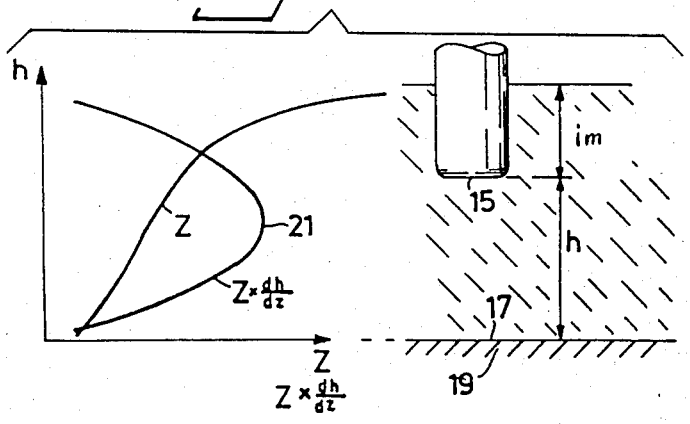
FIG. 4 is a diagram illustrating the principle relationship between the star network impedance Z of an electrode and the height position h thereof, and between the function Z·(dh/dZ) and said height position h.

FIG. 4 illustrates principally a typical relationship for an electrode between on the one hand impedance Z and height positions h and on the other hand the function Z·(dh/dZ), the height position of the electrode tip 15 being calculated, for the sake of illustration, from a zero point which is assumed to coincide with the surface 17 of a highly conductive metal bath 19, for example pig-iron, at the bottom of the furnace. As will be seen, the aforesaid function follows a very specific parabola-like curve, and it has been found possible to utilize this fact to ensure optimal process conditions.

The values on the upper leg of the curve Z·(dh/dZ) have thus been found to give relative values of the highest power with which the electrode in question can be loaded without the highest energy density prevailing in the furnace adjacent respective electrode tips—so-called electrode tip power—becoming excessively great so as to result in overheating of parts of the furnace burden, causing premature slag formation accompanied by pressure blow-outs, hanging and possibly explosions as a result.

The turning point 21 of the curve, i.e. the maximum value for Z·(dh/dZ), corresponds to the highest power take-up ability of the furnace charge and therewith the electrode position affording maximum furnace production. Subsequent to final stabilization the assembled electrode bunch may consequently, if desired, be adjusted to an optimum electrode position, by controlled change of the set-point values of the electrode regulators (i.e. impedance value) on the basis of the measured values of the function Z·(dh/dZ).

The aforesaid electrode tip power corresponds to the expression $I^2$·(dZ/dh) and can thus be monitored, when the so-called derivative method is used. In the case of continuous processes in which the material sinks slowly and uniformly down through the furnace, the electrode tip power has an intimate relationship with the local process temperature adjacent the electrode tip, and can therefore be used as an auxiliary value for monitoring the stability of the temperature and possible variations.

Thus, particularly when there is not available a reliable constructed measuring zero which enables the star network resistance to be determined, it is possible to utilize for the final stabilization the so-called derivative method for obtaining the function values Z·(dh/dZ) for respective electrodes, and using these values as a basis for adjusting conductivity and setting the electrodes in the best position. As a result of the primary stabilization, these function values may often be considered to have good correspondence with the function values R·(dh/dR).

It is emphasized that the height position h may, of course, also be defined in terms of a measurement of im, electrode immersion (see FIG. 4).

We claim:

1. A method of controlling an electrothermal process through a resistive medium, comprising the steps of:

inserting a plurality of electrodes into the resistive medium;

supplying an alternating current to the electrodes so as to heat the resistive medium by passing current therethrough;

forming, with the electrodes, three current-supplied network junction points R, S, and T with a load in a triangular configuration, the load having an electrical zero point;

calculating load impedances of the electrodes;

controlling the positions of the electrodes in the resistive medium on the basis of the calculated load impedances;

taking into account a delta-star transformation by observing the prevailing relationship between delta network impedances and star network impedances;

calculating auxiliary values $Z_1$, $Z_2$ and $Z_3$ of the load, the auxiliary values $Z_1$, $Z_2$ and $Z_3$ being at least representative approximations of the equivalent star network impedances $Z_{RO}$, $Z_{SO}$ and $Z_{TO}$, respectively, through the corresponding relationships $Z_1 \approx K_i \cdot Z_{RO}$, $Z_2 \approx K_2 \cdot Z_{SO}$ and $Z_3 \approx K_3 \cdot Z_{TO}$, where factors $K_1$, $K_2$ and $K_3$ are approximately equal; and adjusting the electrical zero point of the load with the calculated auxiliary values in accordance with desired relationships between the equivalent star network impedances by selectively controlling the respective positions of the electrodes in the resistive medium to control the electrothermal process.

2. A method according to claim 1, wherein the calculating step comprises:

calculating first values $Z'_{RS}$, $Z'_{ST}$ and $Z'_{TR}$ which are at least representative approximations of the delta network impedances $Z_{RS}$, $Z_{ST}$ and $Z_{TR}$, respectively, of the load; and multiplying said first values in pairs to form said auxiliary values $Z_1$, $Z_2$ and $Z_3$ where $Z_1 = Z'_{RS} \cdot Z'_{TR}$, $Z_2 = Z'_{ST} \cdot Z'_{RS}$ and $Z_3 = Z'_{TR} \cdot Z'ST$.

3. A method according to claim 2, wherein the network junction points R, S, T are delta connected to transformer secondary windings and wherein the method further comprises the step of basing each of said first values on delta network current values $I_{RS}$, $I_{ST}$ and $I_{TR}$, respectively.

4. A method according to claim 3, further comprising the step of measuring respective delta network current values on the secondary side of the transformer.

5. A method according to claim 3, further comprising the steps of:

delta-connecting the primary side of the transformer; and measuring respective delta network current value on the primary side of the transformer.

6. A method according to claim 3, further comprising the steps of:

producing delta network currents approximating values $I_{RS}'$, $I_{ST}'$ and $I_{TR}'$, respectively, for use as said delta network current values; and determining star network connected measurements of incoming supply currents $I_{R,in}$, $I_{S,in}$ and $I_{T,in}$ and subsequent delta network connected differential-currents.

7. A method according to any one of claims 3–6, further comprising the step of:

determining said first values with, in addition to the delta network current values, respective associated voltage values, preferably delta network voltage values $U_{RS}$, $U_{ST}$ and $U_{TS}$ respectively associated with the network junction points R, S, T.

8. A method according to claim 2, further comprising the step of:

effecting complete delta-star transformation, the auxiliary values being formed by the values obtained by said pairwise multiplications, each of said values being divided by a factor corresponding to a denominator $\overline{Z}_{RS}+\overline{Z}_{ST}+\overline{Z}_{TR}$.

9. A method according to claim 1, further comprising the steps of:

subsequent to setting the electrical zero point of the load, equalizing, preferably to equality, the height positions of the tip of the electrodes in the resistive medium; and selectively adjusting the conductivity of the resistive medium at the respective electrodes.

10. A method according to claim 9, further comprising the steps of:

determining for the respective electrodes a comparison value corresponding to the relationship between the electrode auxiliary value and the derivative of the auxiliary value with respect to the height position of the electrode tip; and effecting said adjustment on the basis of the comparison values thus determined.

* * * * *